US009297279B2

(12) United States Patent
Yim

(10) Patent No.: US 9,297,279 B2
(45) Date of Patent: Mar. 29, 2016

(54) PUMPING DEVICE USING VAPOR PRESSURE FOR SUPPLYING WATER FOR POWER PLANT

(76) Inventor: Joo Hyuk Yim, Daejeon (KR)

( * ) Notice: Subject to any disclaimer, the term of this patent is extended or adjusted under 35 U.S.C. 154(b) by 0 days.

(21) Appl. No.: 13/989,051

(22) PCT Filed: Oct. 20, 2011

(86) PCT No.: PCT/KR2011/007860
§ 371 (c)(1),
(2), (4) Date: Jun. 13, 2013

(87) PCT Pub. No.: WO2012/091264
PCT Pub. Date: Jul. 5, 2012

(65) Prior Publication Data

US 2014/0047841 A1 Feb. 20, 2014

(30) Foreign Application Priority Data

Dec. 28, 2010 (KR) ..... 10-2010-0136554

(51) Int. Cl.

| | |
|---|---|
| ***F01B 31/16*** | (2006.01) |
| ***F01K 17/00*** | (2006.01) |
| ***F01K 13/00*** | (2006.01) |
| ***F22D 5/26*** | (2006.01) |
| ***F22D 11/02*** | (2006.01) |

(52) U.S. Cl.
CPC . *F01K 13/00* (2013.01); *F22D 5/26* (2013.01); *F22D 11/02* (2013.01)

(58) Field of Classification Search
CPC ..... F01K 13/00; F22D 11/02; F22D 5/26
USPC ..... 122/412, 414, 415; 60/685, 689
See application file for complete search history.

(56) References Cited

U.S. PATENT DOCUMENTS 2,870,751 A * 1/1959 Fadden, Jr. et al. ..... 122/451 R
3,666,918 A * 5/1972 Clark et al. ..... 392/452
(Continued)

FOREIGN PATENT DOCUMENTS

CN 101065559 A 10/2007
JP 59-150794 U 10/1984
(Continued)

OTHER PUBLICATIONS

International Search Report for PCT/KR2011/007860 mailed May 10, 2012.

*Primary Examiner* — Hoang Nguyen
(74) *Attorney, Agent, or Firm* — AKC Patents LLC; Aliki K. Collins

(57) ABSTRACT

The present invention relates to a pumping device using vapor pressure for supplying water for a power plant, which uses the vapor pressure that is stored in a vapor generator used in the power plant to more quickly and readily supply water to the vapor generator without separately using a high-capacity pump and a condenser. The present invention is characterized by significantly saving equipment cost, because various high-capacity pumps and condensers are not required at all, enhancing energy efficiency and operability by eliminating unnecessary power consumption that is used to operate same, reducing maintenance costs, and actively and efficiently preserving nature and the environment by fundamentally eliminating hot water and sewage, which are byproducts of nuclear or thermal power generation, that are discharged into the ocean without treatment.

8 Claims, 4 Drawing Sheets

(56) References Cited

U.S. PATENT DOCUMENTS

| | | | | |
|---|---|---|---|---|
| 4,211,188 | A * | 7/1980 | Chen | 122/451 R |
| 4,258,668 | A * | 3/1981 | Bekedam | 122/1 R |
| 4,285,302 | A * | 8/1981 | Kelly | 122/382 |
| 2014/0199184 | A1* | 7/2014 | Yim | 417/63 |

FOREIGN PATENT DOCUMENTS

| | | |
|---|---|---|
| JP | 62-288422 | 12/1987 |
| JP | 06-241007 | 8/1994 |
| JP | 07-167571 | 7/1995 |
| JP | 08-260909 | 10/1996 |
| JP | 09-264675 | 10/1997 |
| JP | 2002-327930 A | 11/2002 |
| JP | 2008-008217 | 1/2008 |
| JP | 2008-522124 | 6/2008 |
| KR | 20-1990-0006998 | 8/1990 |
| KR | 200352249 | 6/2004 |
| KR | 10-2007-0089837 | 9/2007 |
| KR | 10-2009-0045899 | 5/2009 |

* cited by examiner

PUMPING DEVICE USING VAPOR PRESSURE FOR SUPPLYING WATER FOR POWER PLANT

RELATED APPLICATIONS

This application is a 371 application of International Application No. PCT/KR2011/007860, filed Oct. 20, 2011, which in turn claims priority from Korean Patent Application No. 10-2010-0136554, filed Dec. 28, 2010, each of which is incorporated herein by reference in its entirety.

TECHNICAL FIELD

The present invention relates to a technology for supplying water fast and smoothly without using an additional large capacity pump and a steam condenser in a vapor generator with the aid of a vapor pressure stored in a vapor generator used in a power plant.

BACKGROUND ART

Generally speaking, a nuclear power generation is directed to using an energy generating during the nuclear fission of an atomic nucleus in a nuclear reactor, whereas a thermal power generation is directed to using energy is generating during the combustion of heavy oil and coal, so both the energies are different from each other in terms of the use of energy.

The nuclear power generation and the thermal power generation are same in the way that vapor is generated by boiling water in a vapor generator using the above mentioned energy, and a turbine generator is driven by a driving force generated by rotating a turbine with the generated vapor for thereby generating electric power, and the vapor used so as to rotate the turbine is passed through a steam condenser and is converted into a liquid state through a cooling and condensing procedure which use sea water and is fed back to the vapor generator and is used so as to generate again vapor, which procedures are conducted in the same manner in both the cases through a certain circulation process.

In order to supply water to the vapor generator during the nuclear power and thermal power generations, an additional large capacity cooling water pump for pumping seawater (cooling water) and supplying to the steam condenser and an additional high pressure water supply pump for supplying the water condensed by the steam condenser to the vapor generator are necessarily provided. For this, a facility costs a lot, and an energy efficiency and operation performance become worse since the driving and operation of the pump requires more electric power, and another problems is that a maintenance costs a lot as well.

In addition, even when a high pressure water supply pump is provided, which is designed to supply water to the vapor generator, the pumping does not work as intended at the high pressure pump for a cavitations phenomenon generating owing to an increased temperature. The seawater is heated through the steam condenser in such a way that a cooling water is supplied to the steam condenser and turns to a cooling water with a room temperature and is supplied to the water supply pump. In this case, all the amount of the heated seawater is discharged to sea, which consequently causes critical environmental problems.

In other words, the exhaust water heated as it absorbs heat through a heat exchange procedure while passing through the steam condenser is a sort of a byproduct producing during the nuclear power generation and the thermal power generation. It generally has a temperature 7-13 degree higher than the temperature of typical natural water; however all the amount of the same is discharged to sea, thus resulting in a destroy of natural ecosystem.

Disclosure of Invention

Accordingly, it is an object of the present invention to provide a pumping device using a vapor pressure for supplying water for a power plant which is invented in an attempt to actively improve the problems found in a is conventional art which necessarily used to require a large capacity pump and a steam condenser for the sake of a nuclear power generation and a thermal power generation. In the present invention, the water in a condensate recovery tank is sucked by a strong suction force by temporarily generating a vacuum pressure in a pressurized water tank with the aid of a vapor pressure, and the water is automatically supplemented, and the water can be reliably supplied to the vapor generator with the aid of a vapor pressure generating in the vapor generator installed at the power plant.

In order to overcome the above mentioned problems, the present invention has features in that a turbine rotating with vapor from a vapor generator is installed, and a turbine generator generating electric power with a rotational force from the turbine is installed, and a condensate recovery tank designed to collect the vapor which was used to rotate the turbine is connected with the turbine, and the condensate recovery tank is connected with a pressurized water tank with a supplement water pipe being disposed between them wherein a control valve is installed at the supplement water pipe. The vapor generator and the pressurized water tank are connected each other with a vapor pressure supply pipe being disposed between them wherein a pressure supply control valve is installed at the vapor pressure supply pipe. The pressurization and the vapor generator are connected with a water supply pipe is being disposed between wherein a water supply control valve is installed at the water supply pipe.

In addition, the present invention is directed to a technology of connecting a cooling agent spray pipe to the interior of the pressurized water tank wherein the cooling agent spray pipe sprays a cooling agent into the interior of the pressurized water tank.

Advantageous Effects

According to the present invention, it is possible to supply water to a vapor generator in a continuous and reliable manner with the aid of a vapor pressure stored in a vapor generator during a nuclear power generation as well as a thermal power generation.

In addition, while achieving the above mentioned effects, various large capacity pumps and steam condensers which were necessary in a typical nuclear power generation and thermal power generation are not required in the present invention, so the costs for facilities can be saved a lot, and unnecessary power consumptions during the operations of them can be prevented, thus enhancing an efficiency and operation performance in terms of the use of energy, and the costs for maintenance can be also saved.

The present invention is also advantageous in basically eliminating is the production of warm water exhaust which used to be directly discharged as byproducts of a nuclear power generation and a thermal power generation, thus obtaining useful effects in terms of the preservation of natural ecosystem.

BEST MODES FOR CARRYING OUT THE INVENTION

Figure 1:
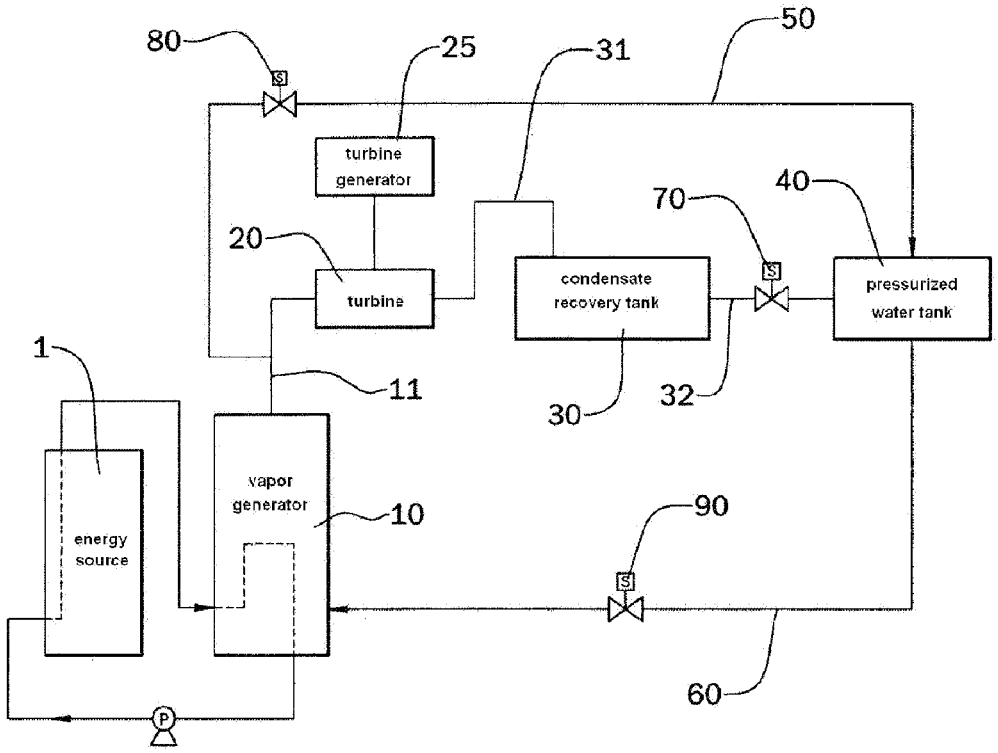
FIG. 1 is a block diagram illustrating the whole constructions of a pumping device for supplying water for a power plane.

The preferred embodiments of the present invention will be described so as to implement in details the solutions of the problems that the present invention aims to overcome.

The whole technical construction according to a preferred embodiment of the present invention will be described in brief with reference to the accompanying drawings. The pumping device using a vapor pressure for supplying water for a power plant comprises a turbine 20 connected through a vapor generator 10 and a vapor pipe 11; a turbine generator 25 generating an electric power with a rotational driving force generated by the turbine 20; a condensate recovery tank 30 connected to the turbine 20 through a condensate pipe 31 for collecting vapor which was used to rotate the turbine 20; a to pressurized water tank 40 connected through the condensate recovery tank 30 and the supplement water pipe 32; a vapor pressure supply pipe 50 connected between the vapor generator 10 and the pressurized water tank 40; a water supply pipe 60 connected between the pressurized water tank 40 and the vapor generator 10; a supplement water control valve 70 installed at a conduit line of is the supplement water pipe 32; a pressure supply control valve 80 installed at a conduit line of the vapor pressure supply pipe 50; and a water supply control valve 90 installed at a conduit line of the water supply pipe 60. It is known that the above listed elements are organically connected.

The present invention formed of the schematic constructions will be described in details for an easier implementation.

The vapor generator 10 according to the present invention is directed to generating and storing vapor produced by boiling water with various energy sources 1 like an energy coming from a nuclear reactor of a nuclear power plant and an energy coming from a thermal power plant. It is integrally connected with the turbine 20 with a vapor pipe 11 being connected between them for thereby rotating the turbine 20 using the vapor from the vapor generator 10. The turbine generator 25 connected with the turbine 20 can generate electric power with the rotational force by the turbine 20.

In addition, the turbine 20 is connected to one side of the condensate recovery tank 30 with the condensate pipe 31 being disposed between them, so the vapor used in rotating the turbine 20 is all collected to the condensate recovery tank 30 for thereby minimizing the loss of energy.

The other side of the condensate recovery tank 30 is connected to the pressurized water tank 40 through the supplement water pipe 32, so it is possible to supplement the condensate of the condensate recovery tank 30 to the pressurized water tank 40, and a water pipe 35 with a level regulating valve 34 regulating the amount of condensate naturally decreasing as much as the amount of vapor during the operation of the turbine 20 is connected to the interior of the condensate recovery tank 30.

Figure 2:
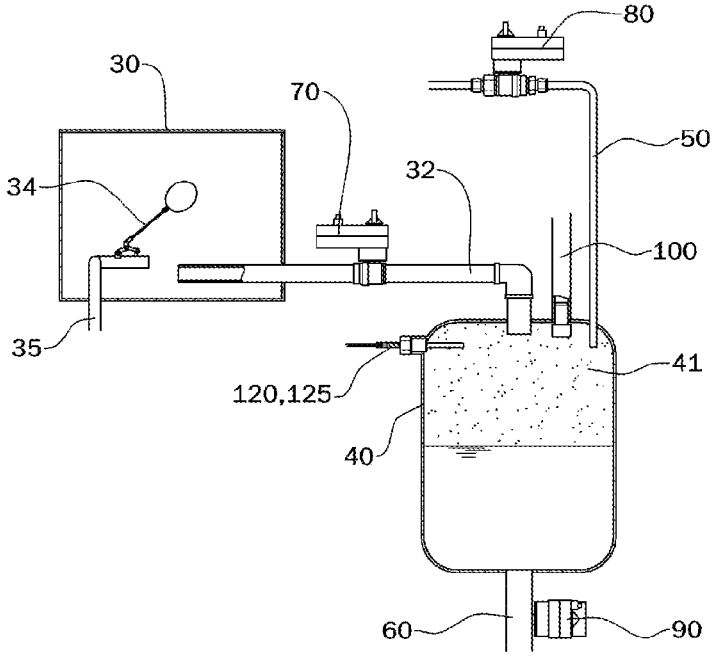
FIG. 2 is a vertical cross sectional view illustrating an installed state of a condensate recovery tank and a pressurized water tank according to the present invention.

Between the vapor generator 10 and the pressurized water tank 40, as shown in FIGS. 1 and 2, is connected a vapor pressure supply pip 50. Between the pressurized water tank 40 and the vapor generator 10 is connected a water supply pipe 60. With this construction, it is possible part of the high pressure vapor pressure stored in the vapor generator 10 to the pressurized water tank 40.

In other words, the present invention is directed to utilizing part of a vapor pressure stored in the vapor generator 10 to the pressurized water tank 40 for thereby making same the inner pressure of the vapor generator 10 and the inner pressure of the pressurized water tank 40, so the water filled in the to pressurized water tank 40 has an effect on a reliable supply to the vapor generator 10, so the present invention is not necessary to use an additional large capacity pump during the above mentioned procedures.

At a conduit line of the supplement water pipe 32 is installed a supplement water control valve 70, and at a conduit line of the vapor pressure supply pipe 50 is installed a pressure supply control valve 80, and at a conduit line of the water supply pipe 60 is installed a water supply control valve 90, the constructions of which provide a convenience when in use since an on and off control can be automatically performed with respect to each flow path depending on a selective operation of the controller.

As shown in FIG. 2, the supplement water pipe 32 of the present invention has features in that one side is connected with the pressurized water tank 40 in a water flow possible way, and the other side is arranged like being immersed under the water in the condensate recovery tank 30 in such a way that the front end of the immersed portion is open.

Figure 3:
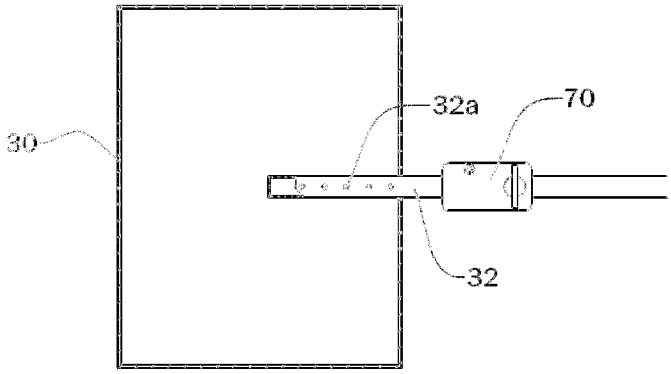
FIGS. 3 to 5 are plane views illustrating a state that a supplement water pipe is connected into the interior of a condensate recovery tank according to the present invention.

A shown in FIG. 3, the supplement water pipe 32 of the present invention is arranged for the other side of the same to be immersed in the interior of the condensate recovery tank 30, and the front end of the immersed portion is sealed with a plurality of nozzle holes 32*a* being formed at an outer surface at regular intervals.

Figure 4:
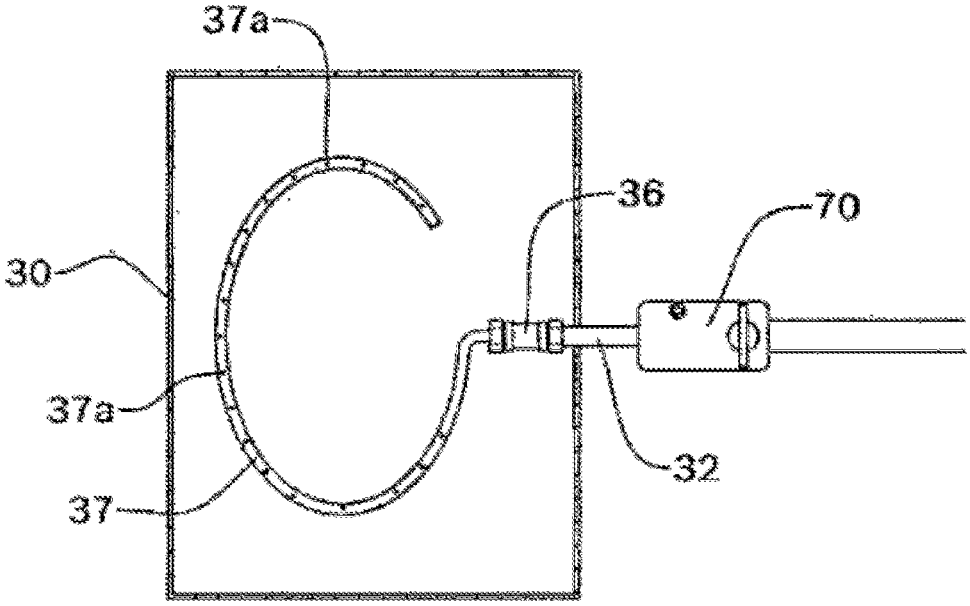

As shown in FIG. 4, the supplement water pipe 32 is arranged in such a way that the other side is immersed in the interior of the condensate recovery tank 30, and a joint 36 is installed at the front end of the immersed portion, and to the joint 36 is connected a discharge and suction header 37 the front end of which is sealed. At an outer surface of the discharge and suction header 37 is provided a plurality of nozzle holes 37*a*.

Figure 5:
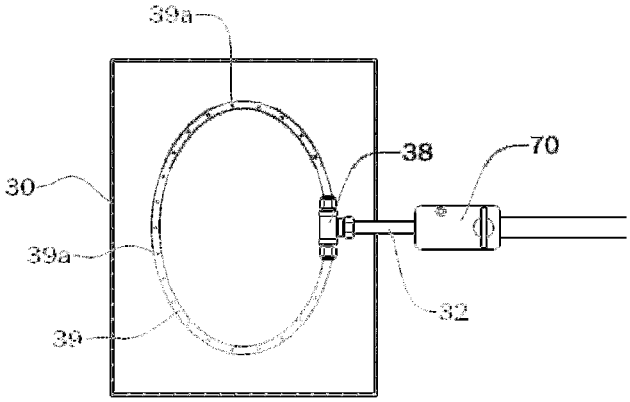

As shown in FIG. 5, the supplement water pipe 32 has features in that the other side is arranged being immersed in the interior of the condensate recovery tank 30, and a branch tee 38 is connected to the front end of the immersed portion, and to both sides of the branch tee 38 are connected the discharge and suction header 39, and at the outer surface of the discharge and suction header 39 are formed a plurality of nozzle holes 39*a*.

Here, the plurality of the nozzle holes 32*a*, 37*a* and 39*a* are formed for the purpose of releasing the sudden discharge of the vapor pressure in order to prevent the phenomenon that water fluctuates and noises occur while a high pressure vapor pressure is discharged toward the condensate recovery tank 30. Since the vapor pressure can be uniformly distributed and discharged over the entire widthwise portions of the condensate recovery tank 30 though the small nozzle holes 32*a*, 37*a*, and 39*a* for thereby reducing the fluctuation of water and the noises and effectively preventing the overflow of water to the outside.

The thusly constructed present invention has features in that part of the vapor pressure is supplied to the pressurized water tank 40, so the water filled in the pressurized water tank 40 can be reliably supplied to the vapor generator 10. With this, when a water level of the pressurized water tank 40 lowers, the water is immediately supplemented to the condensate recovery tank 30.

When the supplement water control valve 70 installed at the supplement water pipe 32 is temporarily opened, the high pressure vapor pressure filled in the vapor layer 41 of the pressurized water tank 40 is directly discharged to the condensate recovery tank 30 through the supplement water pipe 32 or as shown in FIG. 3 it is discharged through the nozzle holes 32*a* formed at the supplement water pipe 32 or as shown in FIGS. 4 and 5, it can be discharged through the discharge and suction headers 37 and 39.

In addition, as the high pressure vapor pressure is discharged, the temperature of the condensate recovery tank 30 increases whereas the temperature of the vapor layer 41 of the pressurized water tank 40 lowers, and liquidation phenomenon occurs. A strong vacuum pressure occurs during the liquidation procedure. So, the water of the condensate recovery tank 30 is directly sucked through the supplement water pipe 32 with the aid of a strong suction force generating due to the vacuum pressure or it can be sucked through the nozzle holes 32*a* formed at the supplement water pipe 32 or it can be sucked through the discharge and suction headers 37 and 39, so the water can be automatically supplemented into the pressurized water tank 40.

When the water of the pressurized water tank 40 reaches the set highest level, the supplement water control valve 70 is automatically close, and the supply of the supplement water is stopped.

Figure 6:
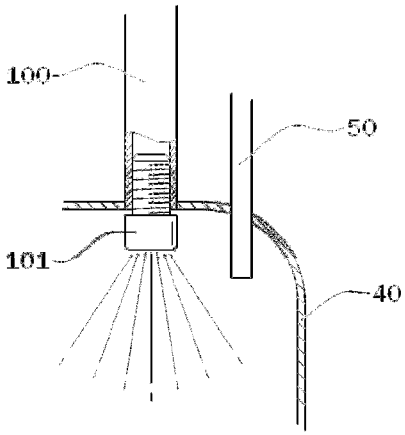
FIG. 6 is an enlarged cross sectional view illustrating a state that a cooling agent spray pipe is installed at a pressurized water tank according to the to present invention.

The present invention has advantageous features in that the supply of the supplement water can be fast performed since the time for generating a vacuum pressure in the interior of the pressurized water tank 40 is reduced in such a way that as shown in FIG. 6, at the top of the pressurized water tank 40, an additional cooling agent spray pipe 100 is connected to the interior, and a spray nozzle 101 is provided at the lower side of the cooling agent spray pipe 100.

Therefore, the vapor pressure filed in the vapor layer 41 of the pressurized water tank 40 is all discharged to the condensate recovery tank 30, and the spray nozzle 101 of the cooling agent spray pipe 100 automatically sprays cooling agent for thereby accelerating liquidation, which makes it possible to significantly reduce the time for generating vacuum pressure.

Figure 7:
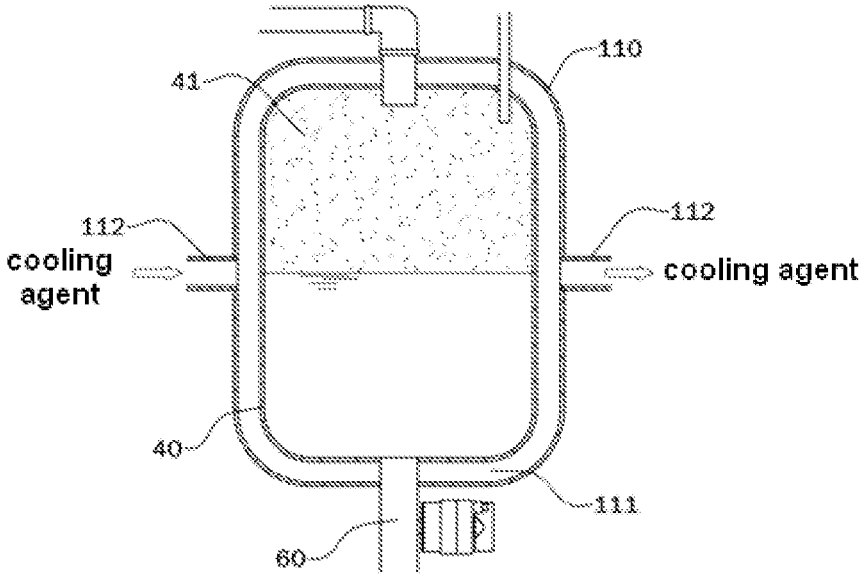
FIG. 7 is a vertical cross sectional view illustrating a state that a cooling jacket is doubly installed at an outer side of a pressurized water tank according to the present invention.

As an alternative for more reducing the time for generating vacuum pressure in the interior of the pressurized water tank 40, as shown in FIG. 7, a cooling jacket 110 with a cooling chamber 111 is doubly installed at an outer side of the pressurized water tank 40, and to both sides of the cooling jacket 110 is connected a cooling agent supply pipe 112, respectively. With this, the liquidation can be accelerated through a heat exchange procedure while the cooling agent supplied through the cooling agent supply pipe 112 passes is through the cooling chamber 111, and the time for producing vacuum pressure can be reduced.

Figure 8:
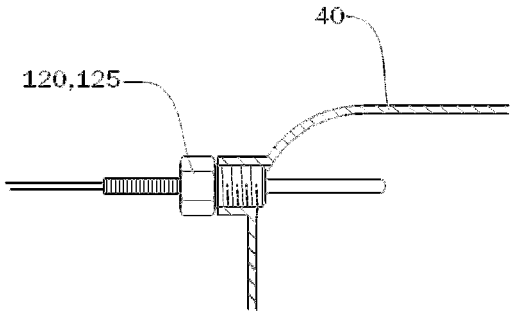
FIG. 8 is an enlarged cross sectional view illustrating a state that a is temperature sensor or a pressure sensor is installed at a pressurized water tank according to the present invention.

In addition, the present invention provides advantageous effects in the way that as shown in FIG. 8, a temperature sensor 120 or a pressure sensor 125 can be further installed in the pressurized water tank 40, with which it is possible to timely spray a cooling agent in such a way to transfer a controls signal to a controller for the cooling agent to be sprayed at the time the temperature sensor 120 or the pressure sensor 125 detects the inner temperature or the inner pressure on an accurate timing when the vapor pressure filled in the vapor layer 41 of the pressurized water tank 40 is all discharged to the condensate recovery tank 30.

The invention claimed is:

1. A pumping device using a vapor pressure for supplying water for a power plant, comprising:

a turbine 20 connected to a vapor generator 10 through a vapor pipe 11;

a turbine generator 25 connected to the turbine 20 and generating an electric power with a rotational driving force generated by the turbine 20;

a condensate recovery tank 30 connected to the turbine 20 through a condensate pipe 31 for collecting vapor which was used to rotate the turbine 20;

a pressurized water tank 40 connected to the condensate recovery tank 30 through a supplement water pipe 32;

a vapor pressure supply pipe 50 connected between the vapor generator 10 and the pressurized water tank 40;

a water supply pipe 60 connected between the pressurized water tank 40 and the vapor generator 10;

a supplement water control valve 70 installed at a conduit line of the supplement water pipe 32;

a pressure supply control valve 80 installed at a conduit line of the vapor pressure supply pipe 50; and a water supply control valve 90 installed at a conduit line of the water supply pipe 60, wherein a cooling agent spray pipe 100 is connected to the interior at the top of the pressurized water tank 40 and being configured to automatically spray cooling agent when the vapor pressure fillet in a vapor layer 41 of the pressurized water tank 40 is all discharged to the condensation recovery tank 30.

2. The pumping device using a vapor pressure for supplying water for a power plant of claim 1, wherein the supplement water pipe 32 is arranged in such a way that its one side is connected to the top of the pressurized water tank 40, and the other side is immersed in the interior of the condensate recovery tank 30, and a front end of the immersed portion is open.

3. The pumping device using a vapor pressure for supplying water for a power plant of claim 1, wherein the supplement water pipe 32 is arranged in such a way that its one side is connected to the top of the pressurized water tank 40, and the other side is immersed in the interior of the condensate recovery tank 30, and a front end of the immersed portion is sealed, and at its outer surface is formed a plurality of nozzle holes 32*a*.

4. The pumping device using a vapor pressure for supplying water for a power plant of claim 1, wherein the supplement water pipe 32 is arranged in such a way that its one side is connected to the top of the pressurized water tank 40, and the other side is immersed in the interior of the condensate recovery tank 30, and wherein a discharge and suction header 37 which has a sealed front end is connected to a joint 36 installed at the front end of the immersed portion, and wherein at an outer surface of the discharge and suction header 37 are formed a plurality of nozzle holes 37*a*.

5. The pumping device using a vapor pressure for supplying water for a power plant of claim 1, wherein the supplement water 32 is arranged in such a way that its one side is connected to the top of the pressurized water tank 40, and the other side is immersed in the interior of the condensate recovery tank 30, and wherein to a front end of the immersed portion is connected a branch tee 38, and to both sides of the branch tee 38 are connected a discharge and suction header 39 and wherein at an outer surface of the discharge and suction header 39 are formed a plurality of nozzle holes 39*a*.

6. The pumping device using a vapor pressure for supplying water for a power plant of claim 1, wherein a cooling jacket 110 with a cooling chamber 11 is further installed at the outer side of the pressurized water tank 40, and wherein both sides of the cooling jacket 110 are connected to a cooling agent supply pipe 112.

7. The pumping device using a vapor pressure for supplying water for a power plant of claim 1, wherein a temperature sensor 120 or a pressure sensor 125 is further installed at pressurized water tank 40.

8. The pumping device using a vapor pressure for supplying water for a power plant of claim 1, wherein the vapor generator 10 is configured to generate vapor by boiling water using an energy source 1 from a nuclear power generation or a thermal power generation.

* * * * *